US010760265B2

(12) United States Patent
Perdue

(10) Patent No.: US 10,760,265 B2
(45) Date of Patent: Sep. 1, 2020

(54) FOLDING VARIABLE ACOUSTIC ASSEMBLY AND METHOD OF USE

(71) Applicant: JayVic, LLC, Amarillo, TX (US)

(72) Inventor: Joab Jay Perdue, Amarillo, TX (US)

( * ) Notice: Subject to any disclaimer, the term of this patent is extended or adjusted under 35 U.S.C. 154(b) by 312 days.

(21) Appl. No.: 15/796,569

(22) Filed: Oct. 27, 2017

(65) Prior Publication Data

US 2018/0119416 A1 May 3, 2018

Related U.S. Application Data

(63) Continuation-in-part of application No. 15/207,311, filed on Jul. 11, 2016, now Pat. No. 10,119,269.

(60) Provisional application No. 62/413,681, filed on Oct. 27, 2016.

(51) Int. Cl.

| | |
|---|---|
| ***E04B 1/99*** | (2006.01) |
| ***G10K 11/16*** | (2006.01) |
| ***E04B 1/84*** | (2006.01) |
| ***E06B 3/48*** | (2006.01) |
| ***E04B 1/82*** | (2006.01) |
| *E04B 1/00* | (2006.01) |

(52) U.S. Cl.

CPC ..... *E04B 1/84* (2013.01); *E04B 1/8209* (2013.01); *E06B 3/48* (2013.01); *G10K 11/16* (2013.01)

(58) Field of Classification Search

CPC ..... E04B 1/994; E04B 1/99; E04B 1/8209; E04B 1/8218; E04B 1/8227; E04B 1/8236; E04B 1/8423; E04B 1/8433; E04B 1/8438; E04B 1/8452; E04B 2001/8476; E04B 2001/849; E04B 2001/7695; E06B 5/20

See application file for complete search history.

(56) References Cited

U.S. PATENT DOCUMENTS 1,675,102 A * 6/1928 Holland ..... G10K 11/20 181/30
1,825,465 A * 9/1931 MacDonald ..... E04B 1/994 181/30
1,896,844 A * 2/1933 Hanson ..... E04B 1/994 181/30

(Continued)

FOREIGN PATENT DOCUMENTS

DE 2724717 A1 * 12/1978 ..... E04B 1/994
WO WO-0242574 A1 * 5/2002 ..... E04B 1/86
WO WO-2016203278 A1 * 12/2016 ..... E04B 1/99

*Primary Examiner* — Edgardo San Martin
(74) *Attorney, Agent, or Firm* — Shannon Warren

(57) ABSTRACT

A variable acoustic system for selectively controlling acoustic properties of an environment. Said variable acoustic system comprises a two side portions, a back portions and a variable expansion assembly. Said variable acoustic system further comprises a shell and a plurality of absorbers. Said variable acoustic system is configured to selectively transition through a one or more configurations. Said one or more configurations comprises at least a closed configuration and an open configuration. Said closed configuration comprises said two side portions closed with said shell exposed. Said open configuration comprises said two side portions open with a portion of said plurality of absorbers exposed. Said shell configured to reflect more acoustic energy than said plurality of absorbers. Said two side portions comprise a first side portion and a second side portion. Said two side portions each comprise at least an outer portions and a back absorbers.

11 Claims, 19 Drawing Sheets

(56) References Cited

U.S. PATENT DOCUMENTS

| | | | | | |
|---|---|---|---|---|---|
| 1,975,604 | A * | 10/1934 | Hanson | E04B 1/994 | 181/30 |
| 3,049,190 | A * | 8/1962 | Coffman | E04B 1/994 | 181/287 |
| 3,411,605 | A * | 11/1968 | Coffman | E04B 1/994 | 181/30 |
| 3,590,354 | A * | 6/1971 | Shiflet | E04B 1/994 | 318/245 |
| 4,875,312 | A * | 10/1989 | Schwartz | E04B 1/994 | 52/144 |
| 6,158,176 | A * | 12/2000 | Perdue | E04B 1/86 | 181/284 |
| 6,209,680 | B1 * | 4/2001 | Perdue | E04B 1/86 | 181/210 |
| 6,431,312 | B1 * | 8/2002 | D'Antonio | E04B 1/994 | 181/295 |
| 7,565,951 | B1 * | 7/2009 | Perdue | E04B 1/86 | 181/284 |
| 8,083,023 | B1 * | 12/2011 | Perdue | E04B 1/8218 | 181/198 |
| 8,573,356 | B1 * | 11/2013 | Perdue | E04B 1/994 | 181/284 |
| 9,322,165 | B2 * | 4/2016 | Luhtala | E04B 1/84 | |
| 10,032,444 | B2 * | 7/2018 | Jambrosic | G10K 11/172 | |
| 10,119,269 | B2 * | 11/2018 | Perdue | E04B 1/994 | |

* cited by examiner

FOLDING VARIABLE ACOUSTIC ASSEMBLY AND METHOD OF USE

CROSS-REFERENCE TO RELATED APPLICATIONS

This application claims benefit to U.S. Patent Application No. 62/413,681 filed on Oct. 27, 2016 and U.S. patent application Ser. No. 15/207,311 filed on Jul. 11, 2016.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant.

None of the known inventions and patents, taken either singularly or in combination, is seen to describe the instant disclosure as claimed.

BRIEF SUMMARY OF THE INVENTION

A variable acoustic system for selectively controlling acoustic properties of an environment. Said variable acoustic system comprises a two side portions, a back portions and a variable expansion assembly. Said variable acoustic system further comprises a shell and a plurality of absorbers. Said variable acoustic system is configured to selectively transition through a one or more configurations. Said one or more configurations comprises at least a closed configuration and an open configuration. Said closed configuration comprises said two side portions closed with said shell exposed. Said open configuration comprises said two side portions open with a portion of said plurality of absorbers exposed. Said shell configured to reflect more acoustic energy than said plurality of absorbers. Said two side portions comprise a first side portion and a second side portion. Said two side portions each comprise at least an outer portions and a back absorbers. Said back absorbers are enclosed within a portion of said back portions. Said outer portions are enclosed in a portion of said two side portions. Portions of each of said two side portions are configured to expand and contract on a plurality of axis hinges.

A variable acoustic system for selectively controlling acoustic properties of an environment. Said variable acoustic system comprises a two side portions, a back portions and a variable expansion assembly. Said variable acoustic system further comprises a shell and a plurality of absorbers. Said variable acoustic system is configured to selectively transition through a one or more configurations. Said one or more configurations comprises at least a closed configuration and an open configuration. Said closed configuration comprises said two side portions closed with said shell exposed. Said open configuration comprises said two side portions open with a portion of said plurality of absorbers exposed. Said shell configured to reflect more acoustic energy than said plurality of absorbers. Said two side portions comprise a first side portion and a second side portion. Said two side portions each comprise at least an outer portions and a back absorbers. Said back absorbers are enclosed within a portion of said back portions. Said outer portions are enclosed in a portion of said two side portions. Portions of each of said two side portions are configured to expand and contract on a plurality of axis hinges. Said two side portions each comprise a middle portions, said outer portions and said back portions. Said outer portions comprise an outer absorbers. Said middle portions comprise an absorber. Said back portions comprise said back absorbers. Said plurality of absorbers comprise all of said outer absorbers, said absorber and said back absorbers. Said outer portions rotate relative to said middle portions on a second axis hinges. Said middle portions rotate relative to said back absorbers on a first axis hinge. Said two side portions expands and contracts on said plurality of axis hinges between said closed configuration and said open configuration.

A method of using an acoustic system comprising: managing acoustic energy by selectively expanding and contracting a two side portions between a closed configuration and an open configuration, reflecting a larger portion of incoming acoustic energy with a variable acoustic system in said closed configuration than in said open configuration. Exposing a plurality of absorbers in said open configuration, and enclosing said plurality of absorbers with said variable acoustic system in said closed configuration and thereby reflecting said incoming acoustic energy on a shell of said variable acoustic system. Wherein. Said variable acoustic system comprises said two side portions, a back portions and a variable expansion assembly. Said variable acoustic system further comprises said shell and said plurality of absorbers. Said variable acoustic system is configured to selectively transition through a one or more configurations. Said one or more configurations comprises at least said closed configuration and said open configuration. Said closed configuration comprises said two side portions closed with said shell exposed. Said open configuration comprises said two side portions open with a portion of said plurality of absorbers exposed. Said shell configured to reflect more acoustic energy than said plurality of absorbers. Said two side portions comprise a first side portion and a second side portion. Said two side portions each comprise at least an outer portions and a back absorbers. Said back absorbers are enclosed within a portion of said back portions. Said outer portions are enclosed in a portion of said two side portions. Portions of each of said two side portions are configured to expand and contract on a plurality of axis hinges. Said two side portions each comprise a middle portions, said outer portions and said back portions. Said outer portions comprise an outer absorbers. Said middle portions comprise an absorber. Said back portions comprise said back absorbers. Said plurality of absorbers comprise all of said outer absorbers, said absorber and said back absorbers. Said outer portions rotate relative to said middle portions on a second axis hinges. Said middle portions rotate relative to said back absorbers on a first axis hinge. Said two side portions expands and contracts on said plurality of axis hinges between said closed configuration and said open configuration.

DETAILED DESCRIPTION OF THE INVENTION

Figure 1:
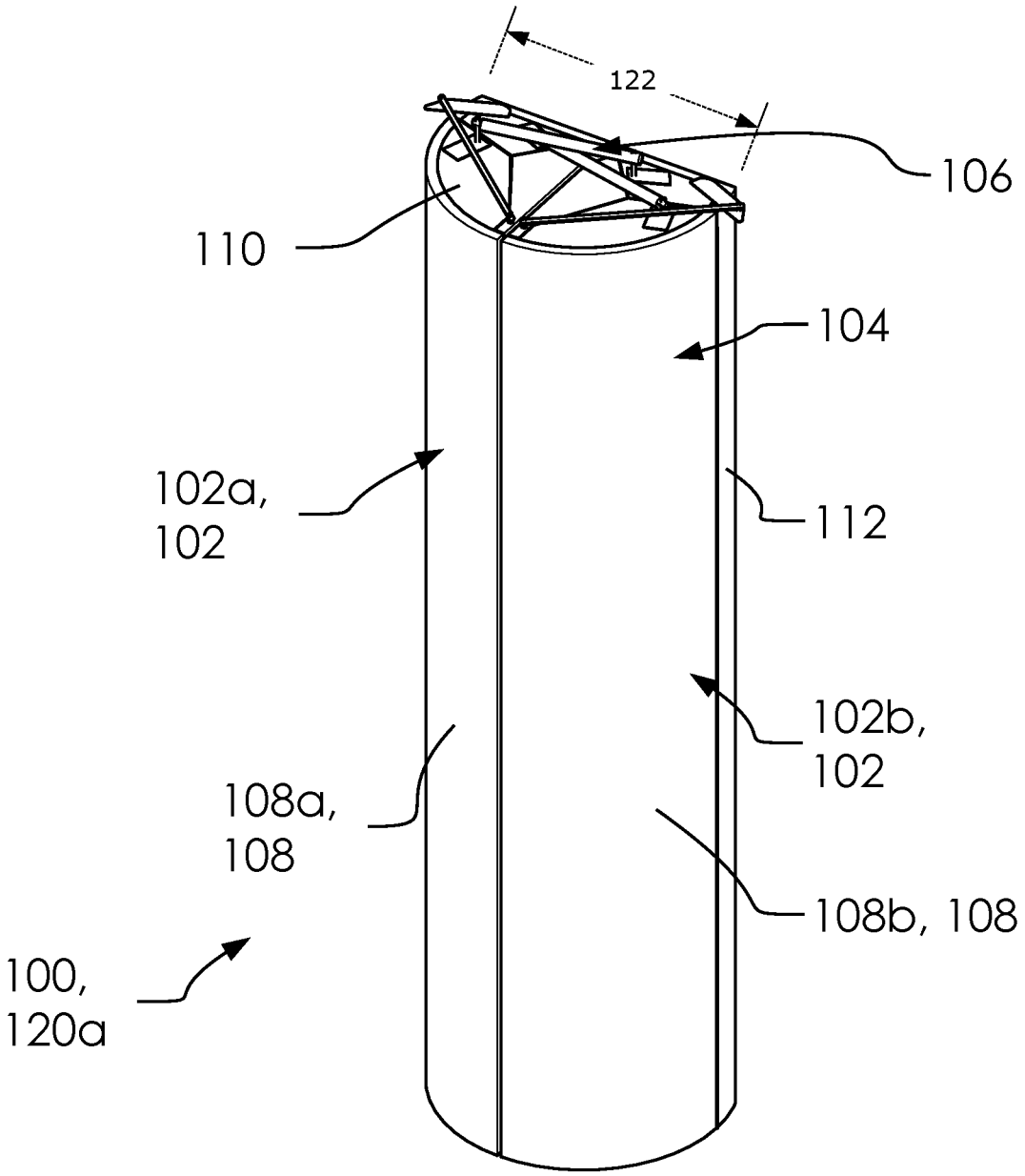
FIG. 1 illustrates a perspective overview view of a closed configuration 120*a* of said variable acoustic system 100.

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

These parts are illustrated in the figures and discussed below:

a variable acoustic system 100
a two side portions 102
a first side portion 102*a*
a second side portion 102*b*
a shell 104
a variable expansion assembly 106
a one or more front shells 108
a first front shell 108*a*
a second front shell 108*b*
a lid portions 110
a back shell 112
a one or more configurations 120
a closed configuration 120*a*
a second configuration 120*b*
a third configuration 120*c*
an open configuration 120*d*
a closed width 122
an outer portions 202
a first outer portion 202*a*
a second outer portion 202*b*
a middle portions 204
a first middle portion 204*a*
a second middle portion 204*b*
a back absorbers 206
a first back absorber 206*a*
a second back absorber 206*b*
a hinges 208
a reflector plates 210
a first reflector plate 210*a*
a second reflector plate 210*b*
an open width 400
an incoming acoustic energy 402
a plurality of axis hinges 500
a first axis hinge 502
a first side first axis hinge 502*a*
a second side first axis hinge 502*b*
a second axis hinges 504
a first side second axis hinge 504*a*
a second side second axis hinge 504*b*
a top portions 600
a one or more brackets 602
a first bracket 602*a*
a second bracket 602*b*
a brackets 604
a first bracket 604*a*
a second bracket 604*b*
a brackets 606 a first bracket 606*a*
a second bracket 606*b*
an actuator assemblies 608
a first actuator assembly 608*a*
a second actuator assembly 608*b*
a rods 610
a first rod 610*a*
a second rod 610*b*
an interior axis 612
a first interior axis 612*a*
a second interior axis 612*b*
an exterior axis 614
a first exterior axis 614*a*
a second exterior axis 614*b*
an interior axis 616
a first interior axis 616*a*
a second interior axis 616*b*
an exterior axis 618
a first exterior axis 618*a*
a second exterior axis 618*b*
a cart 1000
a lift assembly 1002
a one or more wheels 1004
a first wheel 1004*a*
a second wheel 1004*b*
a third wheel 1004*c*
a fourth wheel 1004*d*
a back portions 1200
a one or more top lid portions 1202
a first top lid portion 1202*a*
a second top lid portion 1202*b*
a one or more bottom lid portions 1204
a first bottom lid portion 1204*a*
a second bottom lid portion 1204*b*
a middle portions 1300
a one or more top lid portions 1302
a first top lid portion 1302*a*
a second top lid portion 1302*b*
a one or more bottom lid portions 1304
a first bottom lid portion 1304*a*
a second bottom lid portion 1304*b*
an absorber 1306
an outer portions 1400
an outer absorbers 1402
a first outer absorber 1402*a*
a second outer absorber 1402*b*
a shell portions 1600
a plurality of absorbers 1700
a block diagram 1800
a controller 1802
a control signals 1804
a method of using an acoustic system 1900
a one or more steps 1902
a first step 1902*a*
a second step 1902*b*
a third step 1902*c*
a fourth step 1902*d*

FIG. 1 illustrates a perspective overview view of a closed configuration 120*a* of said variable acoustic system 100.

In one embodiment, said variable acoustic system 100 can comprise said variable acoustic system 100, said shell 104, said variable expansion assembly 106, said one or more front shells 108, said lid portions 110, said back shell 112, said one or more configurations 120, said closed configuration 120*a*, said second configuration 120*b*, said third configuration 120*c* and said open configuration 120*d*.

In one embodiment, said two side portions 102 can comprise said first side portion 102*a* and said second side portion 102*b*.

In one embodiment, said shell 104 can comprise said variable expansion assembly 106, said lid portions 110 and said back shell 112.

In one embodiment, said one or more front shells 108 can comprise said first front shell 108*a* and said second front shell 108*b*.

In one embodiment, said one or more configurations 120 can comprise said closed configuration 120*a*, said second configuration 120*b*, said third configuration 120*c* and said open configuration 120*d*.

In one embodiment, said closed configuration 120*a* can comprise said closed width 122.

In one embodiment, said variable acoustic system 100 can transition between said one or more configurations 120 to change acoustic properties of an environment. Said variable acoustic system 100 can comprise a largely reflective sound profile in said closed configuration 120*a* and a largely absorbent profile in said open configuration 120*d*.

Said variable expansion assembly 106 can be controlled remotely to move said variable acoustic system 100 through said one or more configurations 120.

Said shell 104 can be a mostly solid shell to protect the absorbent portions within.

In one embodiment, said shell 104 can comprise one or more front shells 108, lid portions 110 and other parts to be introduced below. In one embodiment, shell 104 can comprise an unibody construction. In one embodiment, shell 104 can be a plastic material or similar.

Figure 2:
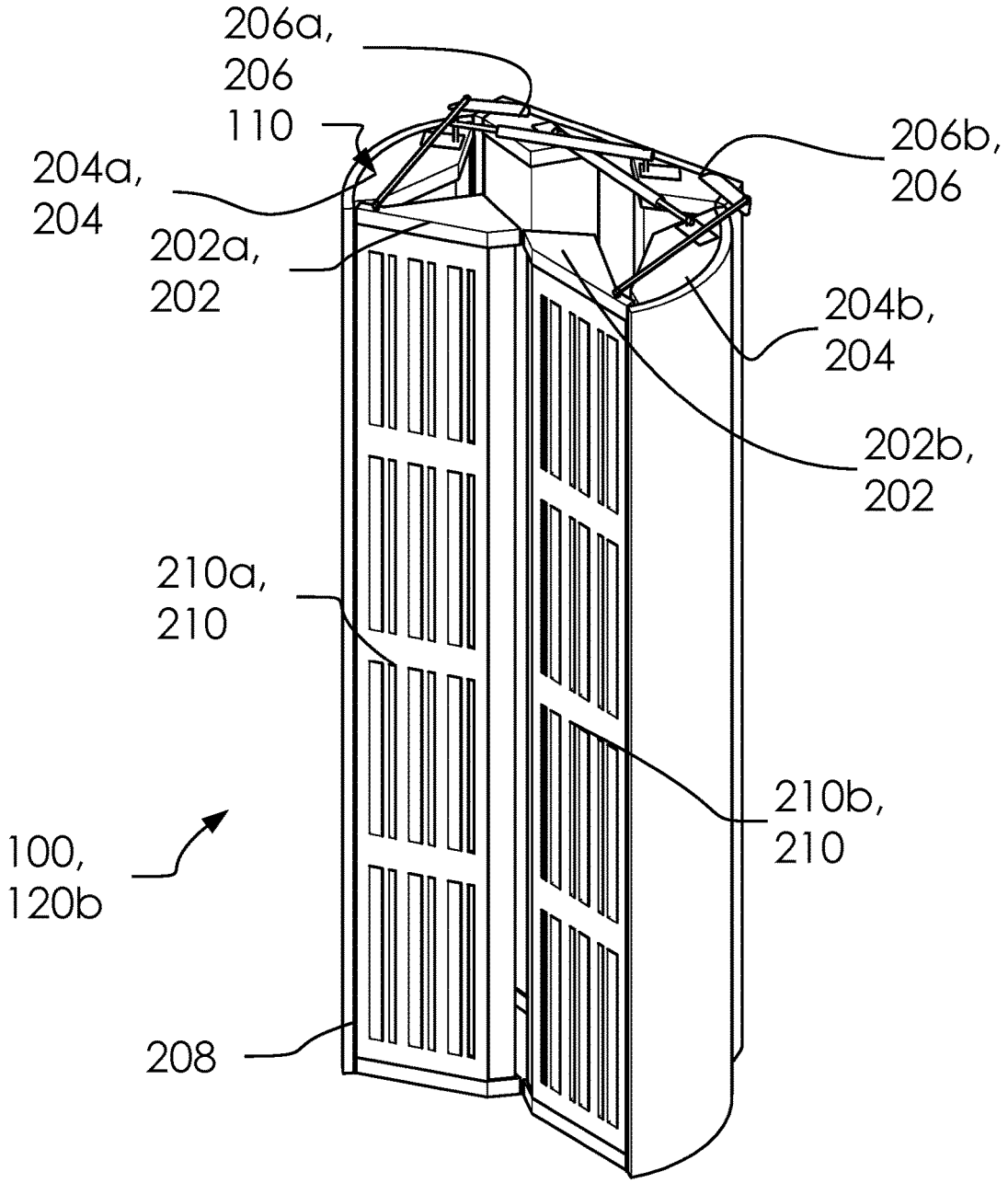
FIG. 2 illustrates a perspective overview view of a second configuration 120*b* of said variable acoustic system 100.

FIG. 2 illustrates a perspective overview view of a second configuration 120*b* of said variable acoustic system 100.

In one embodiment, said outer portions 202 can comprise said first outer portion 202*a* and said second outer portion 202*b*.

In one embodiment, said middle portions 204 can comprise said first middle portion 204*a* and said second middle portion 204*b*.

In one embodiment, said back absorbers 206 can comprise said first back absorber 206*a* and said second back absorber 206*b*.

In one embodiment, said reflector plates 210 can comprise said first reflector plate 210*a* and said second reflector plate 210*b*.

In one embodiment, said variable acoustic system 100 can comprise said second outer portion 202*b*, said second middle portion 204*b*, said hinges 208 and said hinges 208.

Said variable acoustic system 100 can comprise said outer portions 202, said middle portions 204 and said back absorbers 206 folded into one another, as illustrated. One job of said variable expansion assembly 106 is to move said outer portions 202 and said middle portions 204 relative to one another in a very particular path.

Said outer portions 202 can comprise said reflector plates 210 which are designed to absorb and cancel sound, as is known in the art.

Said outer portions 202, said middle portions 204 said back absorbers 206 rotate relative to one another on said hinges 208, as shown.

In one embodiment, reflector plates 210 can be configured for binary amplitude reflection of incoming acoustic energy 402. With variable acoustic system 100 in closed configuration 120*a*, variable acoustic system 100 can be majority spatulated and almost completely non-absorbent. With variable acoustic system 100 in open configuration 120*d* said variable acoustic system 100 can be as almost completely absorbent and substantially non-spatulated. second configuration 120*b* and third configuration 120*c* an comprise portions spatulated and absorbent.

Figure 3:
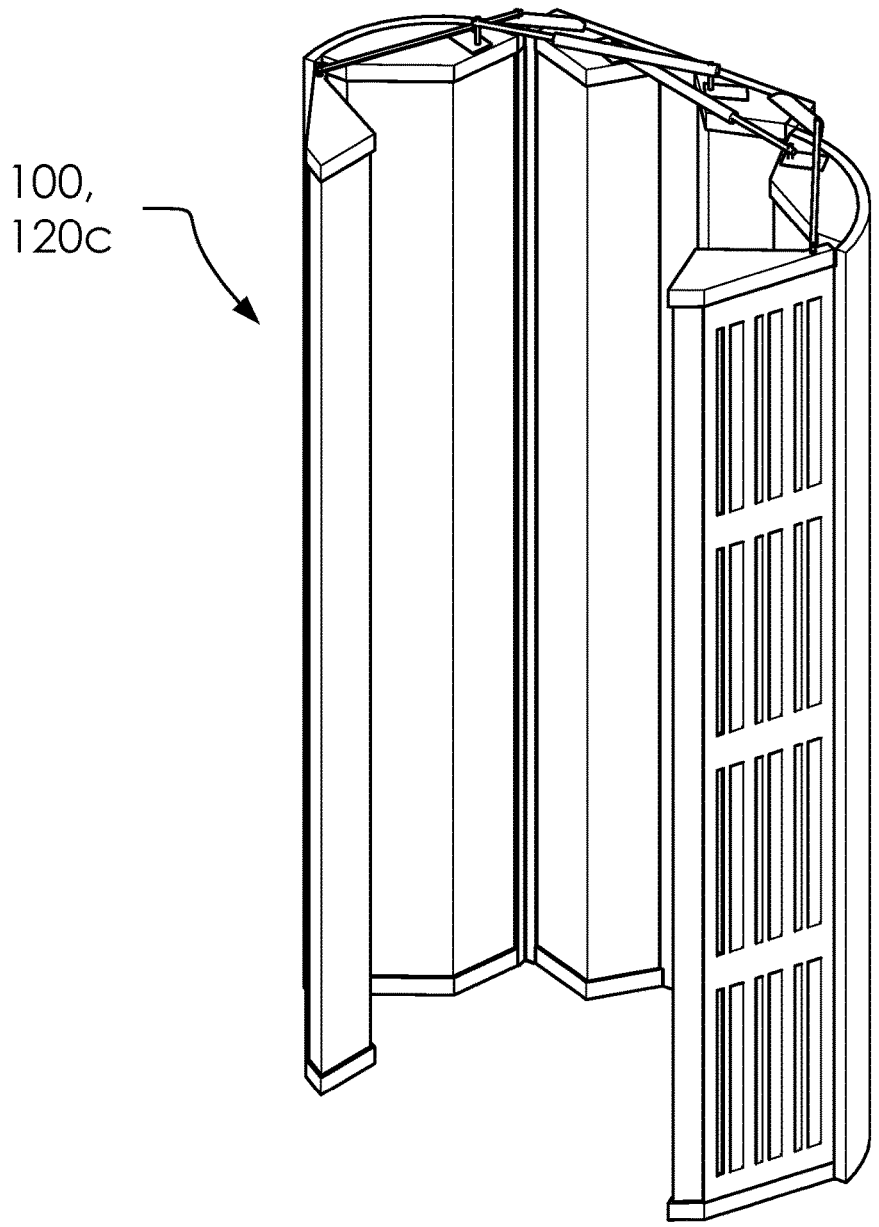
FIG. 3 illustrates a perspective overview view of a third configuration 120*c* of said variable acoustic system 100.

FIG. 3 illustrates a perspective overview view of a third configuration 120*c* of said variable acoustic system 100.

Figure 4:
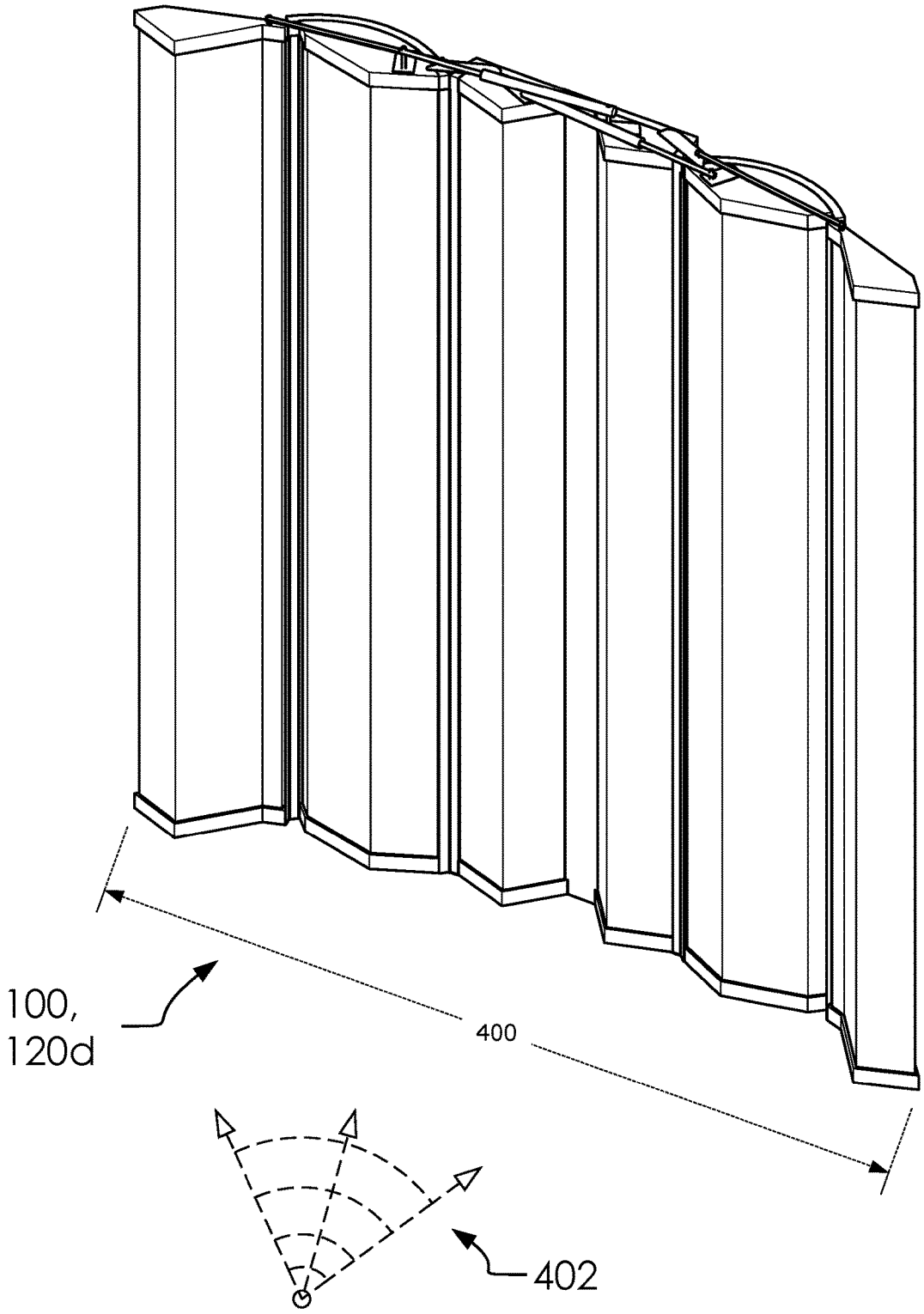
FIG. 4 illustrates a perspective overview view of an open configuration 120*d* of said variable acoustic system 100.

FIG. 4 illustrates a perspective overview view of an open configuration 120*d* of said variable acoustic system 100.

In one embodiment, said closed configuration 120*a* can comprise said open width 400.

With variable acoustic system 100 in open configuration 120*d*, said variable acoustic system 100 can absorb incoming acoustic energy 402 with plurality of absorbers 1700; with variable acoustic system 100 in closed configuration 120*a* said incoming acoustic energy 402 can reflect off of a portion of shell 104.

In one embodiment, open width 400 can be more than double closed width 122.

Figure 5A:
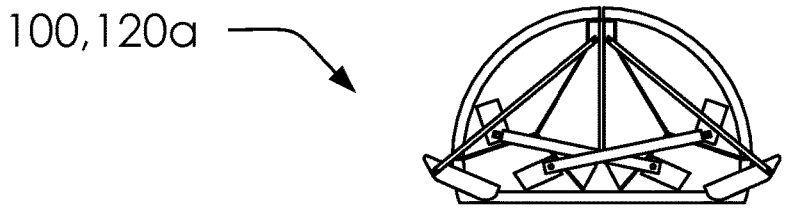
FIG. 5A illustrates an elevated top side view of a closed configuration 120*a*.

FIG. 5A illustrates an elevated top side view of a closed configuration 120*a*.

Figure 5B:
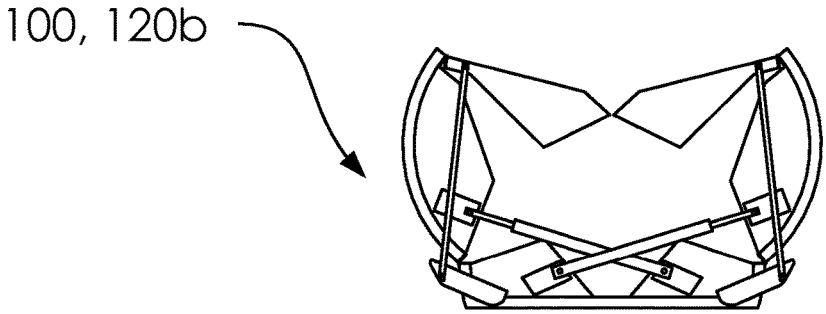
FIG. 5B illustrates an elevated top side view of a second configuration 120*b*.

FIG. 5B illustrates an elevated top side view of a second configuration 120*b*.

Figure 5C:
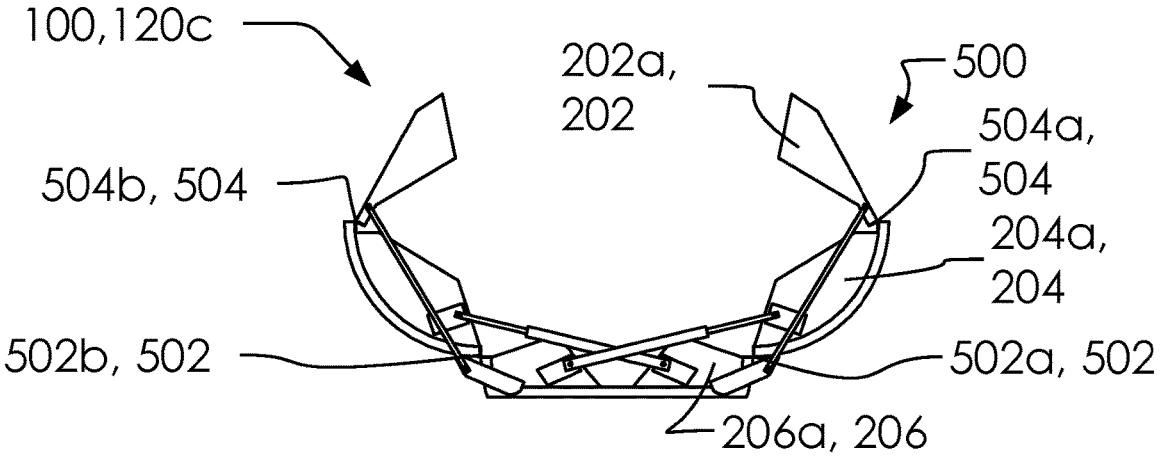
FIG. 5C illustrates an elevated top side view of a third configuration 120*c*.

FIG. 5C illustrates an elevated top side view of a third configuration 120*c*.

Figure 5D:
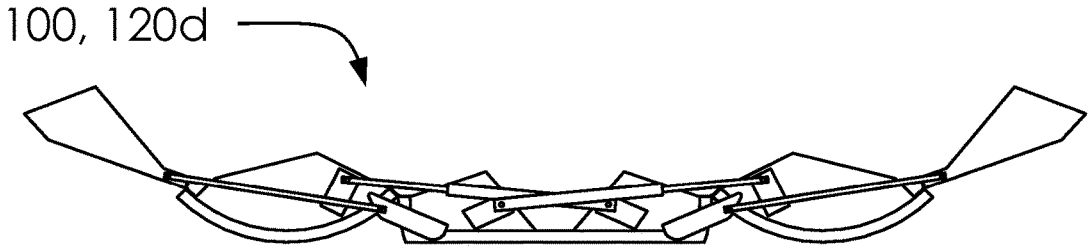
FIG. 5D illustrates an elevated top side view of an open configuration 120*d*.

FIG. 5D illustrates an elevated top side view of an open configuration 120*d*.

In one embodiment, said plurality of axis hinges 500 can comprise said plurality of axis hinges 500, said first axis hinge 502, said second side first axis hinge 502*b* and said second axis hinges 504.

In one embodiment, said first axis hinge 502 can comprise said first side first axis hinge 502*a* and said second side first axis hinge 502*b*.

In one embodiment, said second axis hinges 504 can comprise said first side second axis hinge 504*a* and said second side second axis hinge 504*b*.

In one embodiment, said two side portions 102 can comprise said plurality of axis hinges 500.

Referring to FIG. 5C, said outer portions 202 can rotate relative to middle portions 204 on said second axis hinges 504; said middle portions 204 can rotate relative to back absorbers 206 on first axis hinge 502. Accordingly, two side portions 102 can expand and contract on plurality of axis hinges 500 between closed configuration 120*a* and open configuration 120*d*.

In one embodiment, plurality of axis hinges 500 can comprise substantially vertical rotating axes such that variable acoustic system 100 can open horizontally when mounted on a wall in a vertical position. Another way of considering this dynamic is to say that plurality of axis hinges 500 are perpendicular to the direction of movement of two side portions 102 as between one or more configurations 120.

Figure 6A:
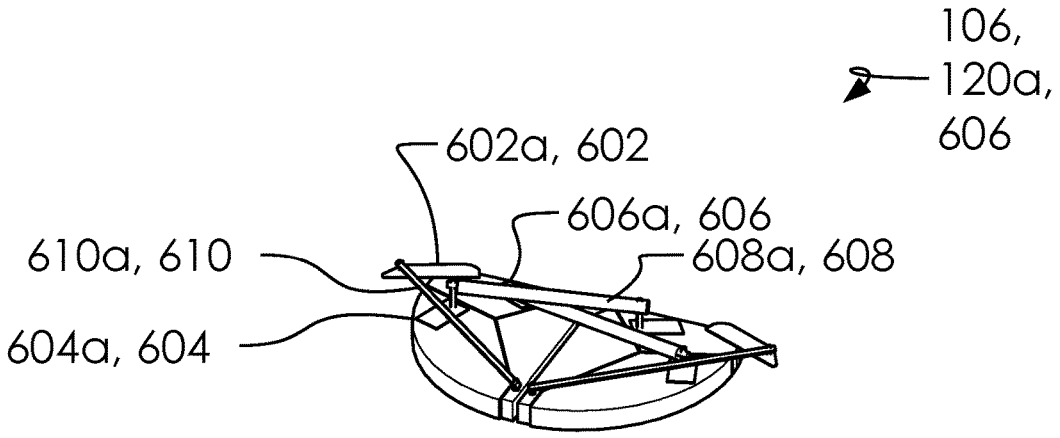
FIGS. 6A and 6B illustrate a perspective overview of a top portions 600 in said closed configuration 120*a*.
Figure 6B:
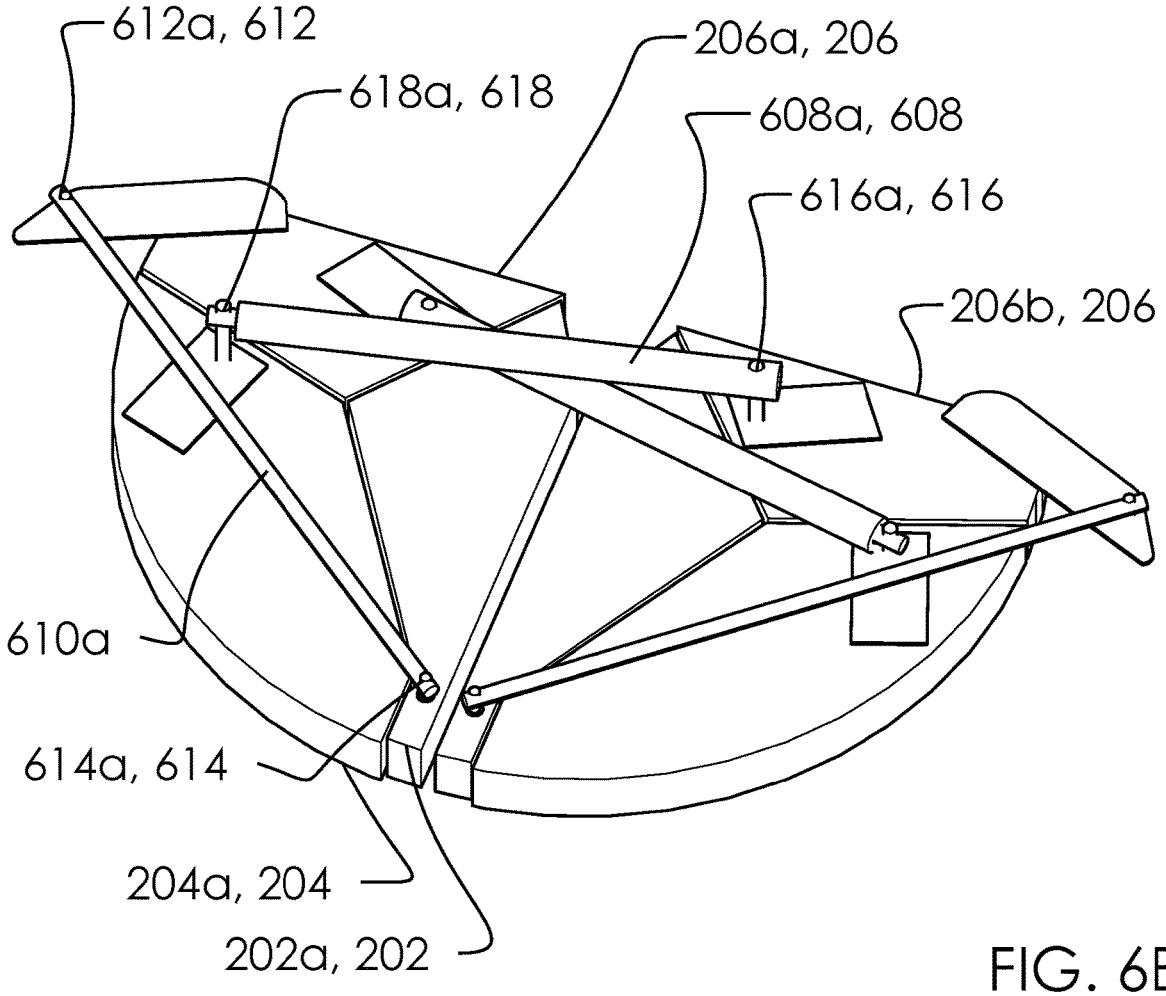

FIGS. 6A and 6B illustrate a perspective overview of a top portions 600 in said closed configuration 120*a*.

In one embodiment, said one or more brackets 602 can comprise said first bracket 602*a* and said second bracket 602*b*.

In one embodiment, said brackets 604 can comprise said first bracket 604*a* and said second bracket 604*b*.

In one embodiment, said brackets 606 can comprise said first bracket 606*a* and said second bracket 606*b*.

In one embodiment, said actuator assemblies 608 can comprise said first actuator assembly 608*a*, said second actuator assembly 608*b*, said interior axis 616, said exterior axis 618 and said second exterior axis 618*b*.

In one embodiment, said rods 610 can comprise said interior axis 612 and said exterior axis 614.

In one embodiment, said interior axis 612 can comprise said first interior axis 612*a* and said second interior axis 612*b*.

In one embodiment, said exterior axis 614 can comprise said first exterior axis 614*a* and said second exterior axis 614*b*.

In one embodiment, said interior axis 616 can comprise said first interior axis 616*a* and said second interior axis 616*b*.

In one embodiment, said exterior axis 618 can comprise said first exterior axis 618*a* and said second exterior axis 618*b*.

In one embodiment, said variable acoustic system 100 can comprise said top portions 600.

In one embodiment, said two side portions 102 can comprise said second bracket 602*b*, said second bracket 604*b*, said second bracket 606*b* and said second actuator assembly 608*b*.

In one embodiment, said variable expansion assembly 106 can comprise said one or more brackets 602, said brackets 604, said brackets 606, said actuator assemblies 608 and said rods 610.

In one embodiment, each side of said two side portions 102 can comprise said one or more brackets 602, said brackets 604, said brackets 606, said actuator assemblies 608 and said rods 610.

In one embodiment, variable expansion assembly 106 can control movement of two side portions 102 through one or more configurations 120.

In one embodiment, brackets 606 can selectively expand and contract to move portions of variable expansion assembly 106 through one or more configurations 120 between closed configuration 120*a* and 102*d*/.

In one embodiment, brackets 606 can push portions of middle portions 204 away from back portions 1200; and rods 610 can guide movement of outer portions 202 relative to back portions 1200, as illustrated.

In one embodiment, brackets 606 can rotateably mounted between back absorbers 206 and middle portions 204. actuator assemblies 608 can be mounted to back absorbers 206 with interior axis 616 and to middle portions 204 with exterior axis 618. Said interior axis 616 can be mounted across variable expansion assembly 106 with first middle portion 204*a* attached to second back absorber 206*b* and second middle portion 204*b* attached to first back absorber 206*a*. Accordingly, actuator assemblies 608 can be configured to push middle portions 204 away from an opposite side of variable expansion assembly 106. In one embodiment, rods 610 can be rotateably attached between a portion of back absorbers 206 and outer portions 202, with interior axis 612 attaching back absorbers 206 to rods 610, and exterior axis 614 rotateably attached to outer portions 202. Accordingly, when actuator assemblies 608 selectively expand and contract, said middle portions 204 and outer portions 202 rotate and expand between closed configuration 120*a* and open configuration 120*d*.

actuator assemblies 608 can comprise hydro-powered, pneumatic-powered and electric powered actuators, as is known in the art. In a preferred embodiment actuator assemblies 608 are electric powered.

Figure 7A:
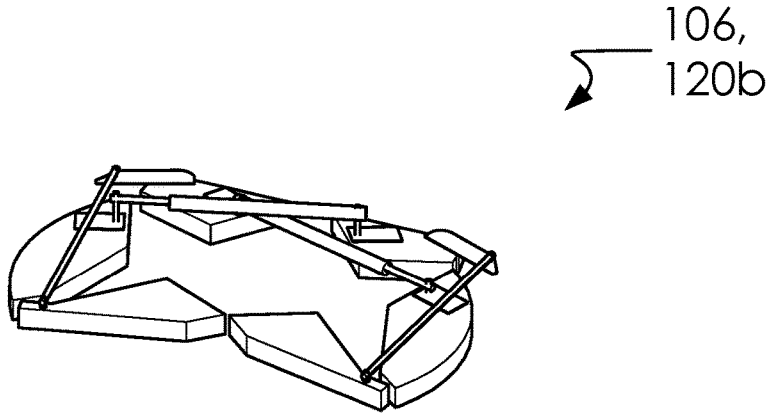
FIGS. 7A and 7B illustrate a perspective overview and an elevated top view of a top portions 600 in said second configuration 120*b*.
Figure 7B:
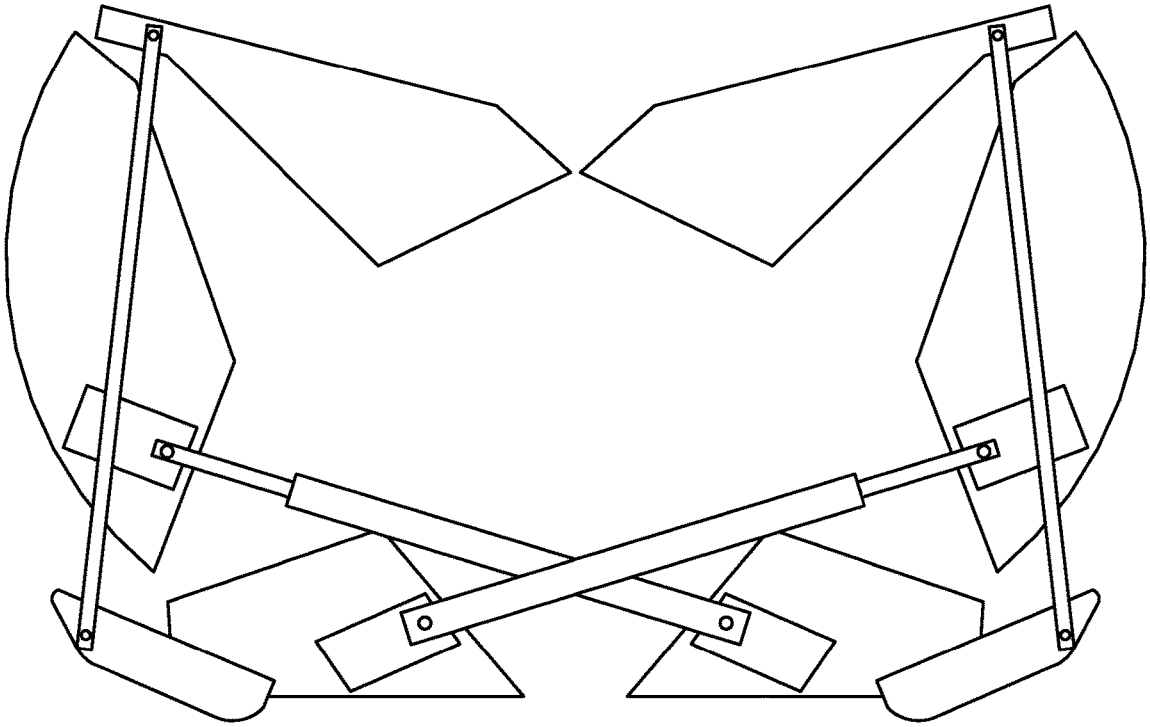

FIGS. 7A and 7B illustrate a perspective overview and an elevated top view of a top portions 600 in said second configuration 120*b*.

Figure 8:
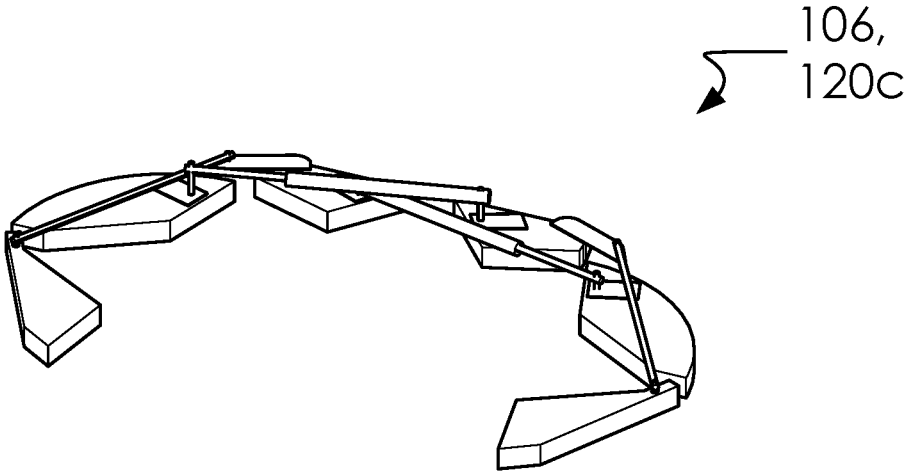
FIG. 8 illustrates a perspective overview view of a top portions 600 in said third configuration 120*c*.

FIG. 8 illustrates a perspective overview view of a top portions 600 in said third configuration 120*c*.

Figure 9:
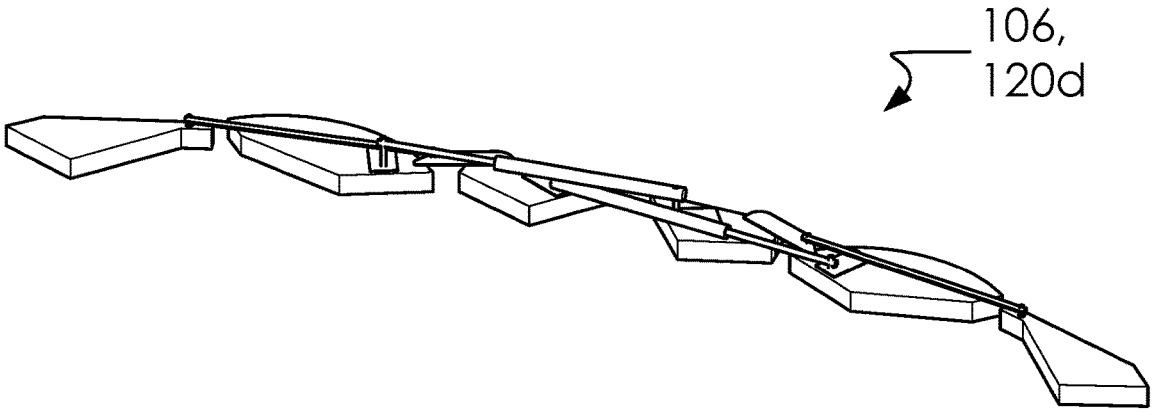
FIG. 9 illustrates a perspective overview view of a top portions 600 in said open configuration 120*d*.

FIG. 9 illustrates a perspective overview view of a top portions 600 in said open configuration 120*d*.

Figure 10:
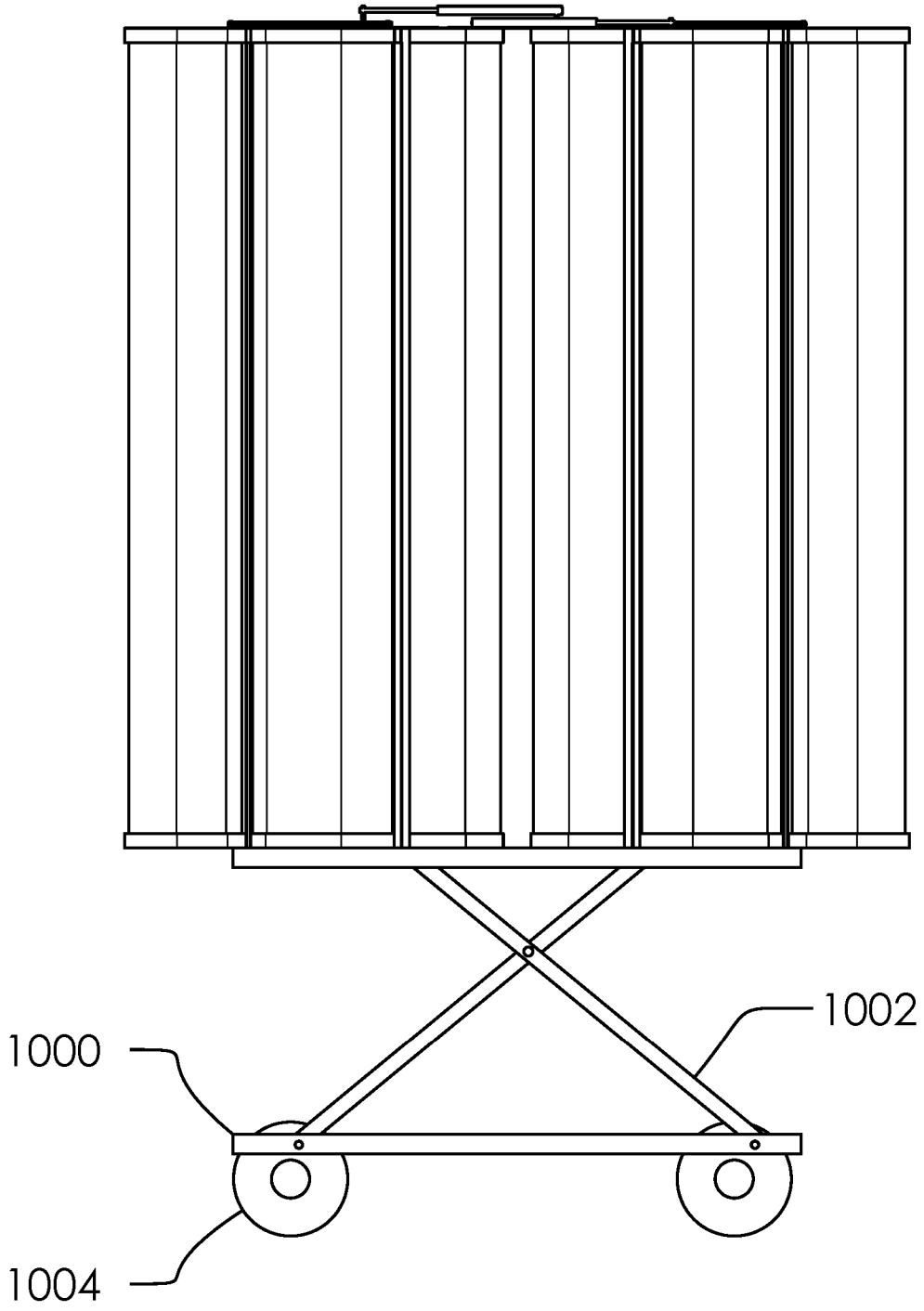
FIG. 10 illustrates an elevated front side view of a cart 1000 with said variable acoustic system 100 in said open configuration 120*d*, in a lifted configuration.

FIG. 10 illustrates an elevated front side view of a cart 1000 with said variable acoustic system 100 in said open configuration 120*d*, in a lifted configuration.

In one embodiment, said cart 1000 can comprise said lift assembly 1002 and said one or more wheels 1004.

In one embodiment, said one or more wheels 1004 can comprise said first wheel 1004*a*, said second wheel 1004*b*, said third wheel 1004*c* and said fourth wheel 1004*d*.

In one embodiment, said variable acoustic system 100 can comprise said cart 1000.

Figure 11:
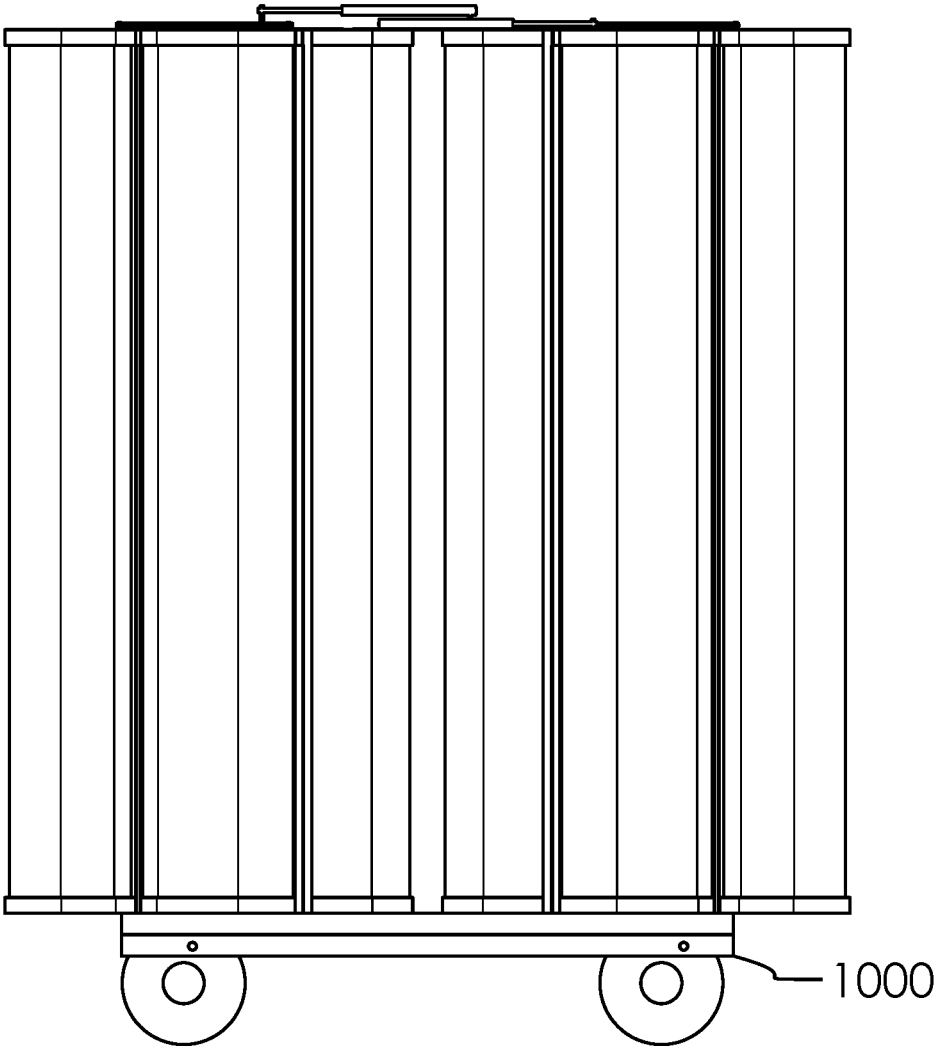
FIG. 11 illustrates an elevated front side view of a cart 1000 with said variable acoustic system 100 in said open configuration 120*d*, in a closed configuration.

Said cart 1000 can comprise a cart with a variable height setting for moving said variable acoustic system 100 up and down, as shown in FIG. 10-11. Said cart 1000 can be an off the shell part.

In another embodiment, said variable acoustic system 100 can be mounted to tracks or other mechanisms for movement up and down a wall, as is known in the art.

FIG. 11 illustrates an elevated front side view of a cart 1000 with said variable acoustic system 100 in said open configuration 120*d*, in a closed configuration.

Figure 12A:
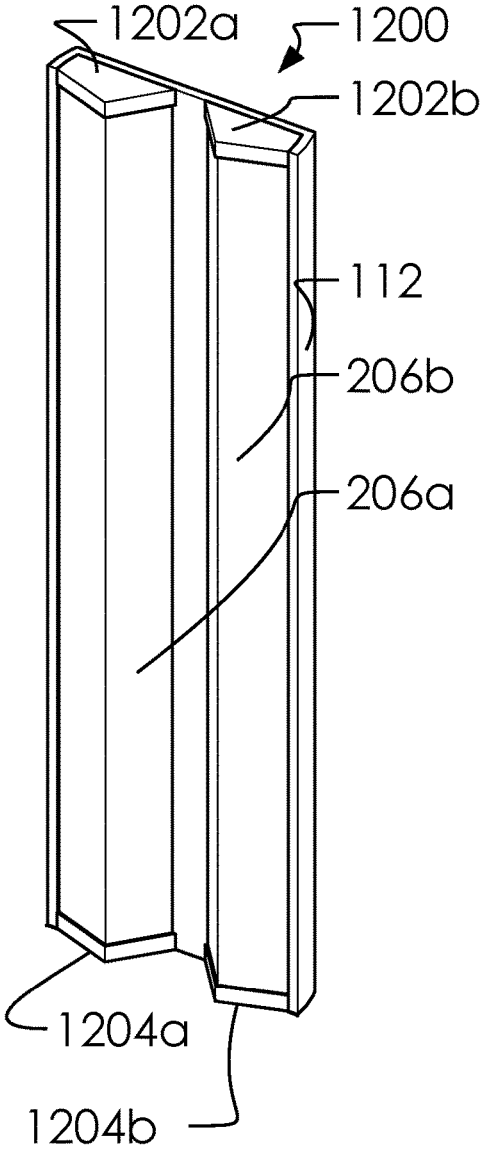
FIG. 12A illustrates a perspective overview view of a back portions 1200.

FIG. 12A illustrates a perspective overview view of a back portions 1200.

Figure 12B:
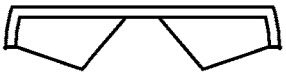
FIG. 12B illustrates an elevated top side view of a back portions 1200.

FIG. 12B illustrates an elevated top side view of a back portions 1200.

Figure 12C:
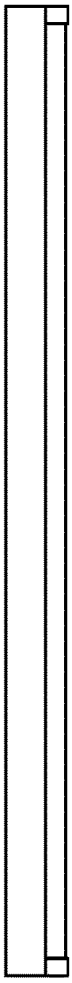
FIG. 12C illustrates an elevated first side view of a back portions 1200.

FIG. 12C illustrates an elevated first side view of a back portions 1200.

Figure 12D:
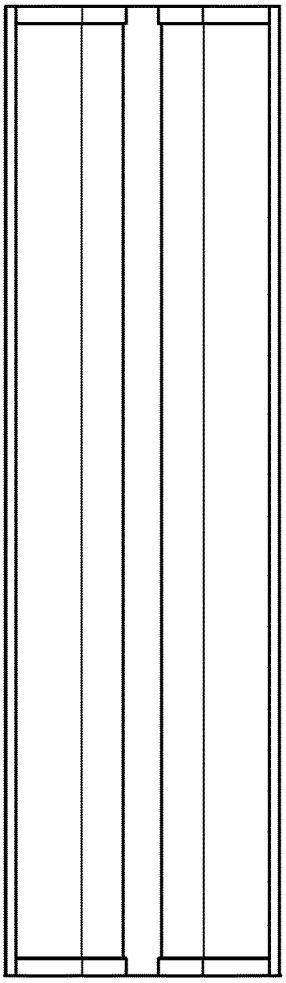
FIG. 12D illustrates an elevated front side view of a back portions 1200.

FIG. 12D illustrates an elevated front side view of a back portions 1200.

In one embodiment, said back portions 1200 can comprise said second top lid portion 1202*b*.

In one embodiment, said one or more top lid portions 1202 can comprise said first top lid portion 1202*a* and said second top lid portion 1202*b*.

In one embodiment, said one or more bottom lid portions 1204 can comprise said first bottom lid portion 1204*a* and said second bottom lid portion 1204*b*.

In one embodiment, said variable acoustic system 100 can comprise said back portions 1200.

Figure 13A:
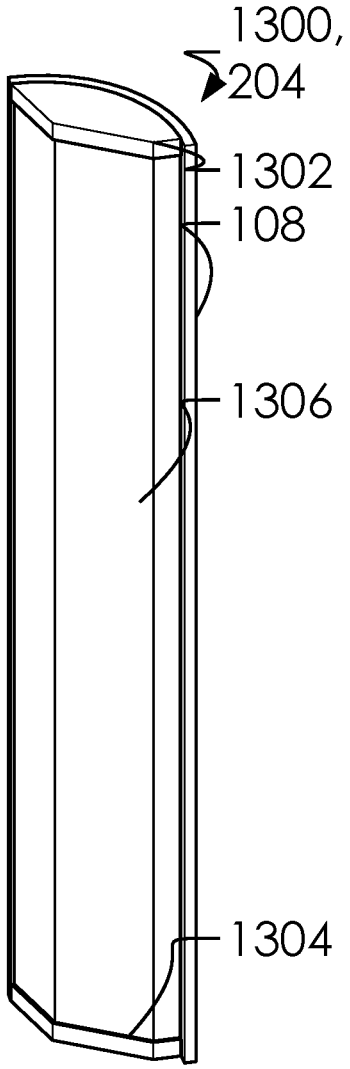
FIG. 13A illustrates a perspective overview view of a middle portions 1300.

FIG. 13A illustrates a perspective overview view of a middle portions 1300.

Figure 13B:
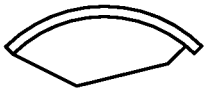
FIG. 13B illustrates an elevated top side view of a middle portions 1300.

FIG. 13B illustrates an elevated top side view of a middle portions 1300.

Figure 13C:
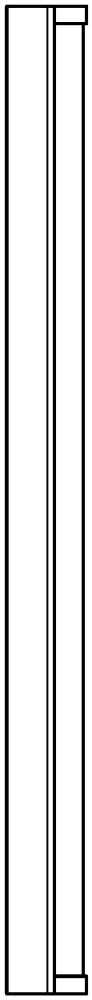
FIG. 13C illustrates an elevated first side view of a middle portions 1300.

FIG. 13C illustrates an elevated first side view of a middle portions 1300.

Figure 13D:
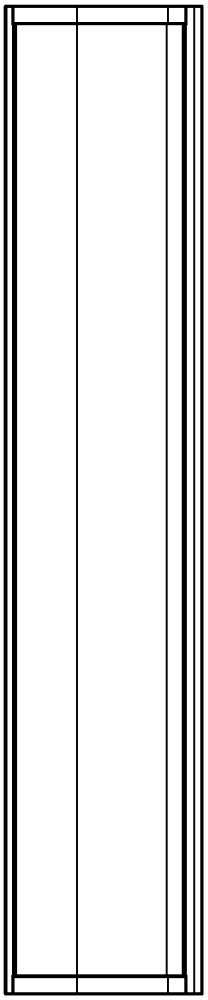
FIG. 13D illustrates an elevated front side view of a middle portions 1300.

FIG. 13D illustrates an elevated front side view of a middle portions 1300.

In one embodiment, said middle portions 1300 can comprise said one or more top lid portions 1302, said first bottom lid portion 1304*a* and said absorber 1306.

In one embodiment, said one or more top lid portions 1302 can comprise said first top lid portion 1302*a* and said second top lid portion 1302*b*.

In one embodiment, said one or more bottom lid portions 1304 can comprise said first bottom lid portion 1304*a* and said second bottom lid portion 1304*b*.

In one embodiment, said variable acoustic system 100 can comprise said middle portions 1300.

In one embodiment, said back portions 1200 can comprise said middle portions 1300.

Figure 14A:
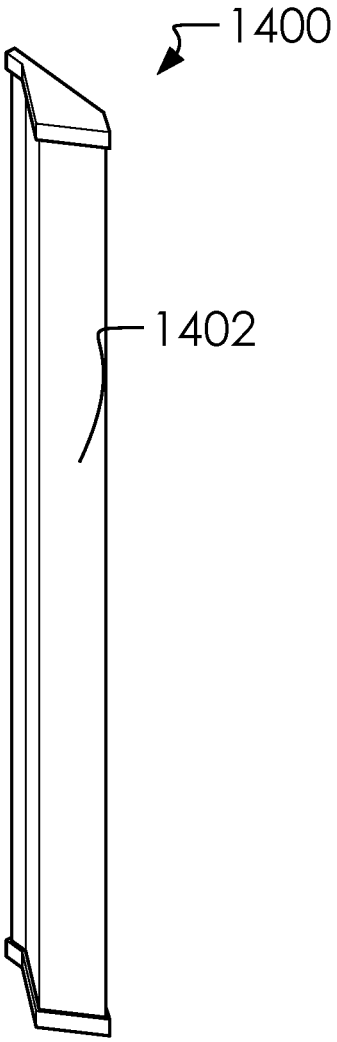
FIG. 14A illustrates a perspective overview view of an outer portions 1400.

FIG. 14A illustrates a perspective overview view of an outer portions 1400.

Figure 14B:
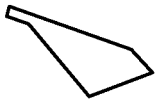
FIG. 14B illustrates an elevated top side view of an outer portions 1400.

FIG. 14B illustrates an elevated top side view of an outer portions 1400.

Figure 14C:
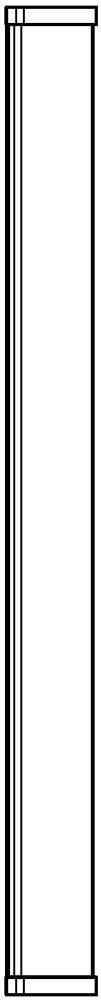
FIG. 14C illustrates an elevated first side view of an outer portions 1400.

FIG. 14C illustrates an elevated first side view of an outer portions 1400.

Figure 14D:
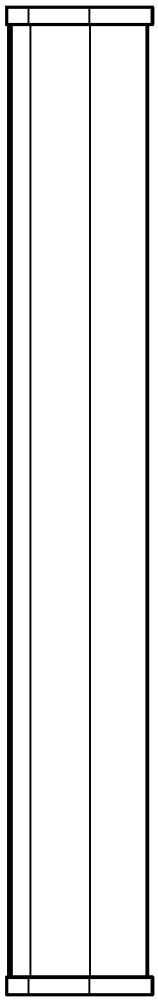
FIG. 14D illustrates an elevated front side view of an outer portions 1400.

FIG. 14D illustrates an elevated front side view of an outer portions 1400.

In one embodiment, said outer absorbers 1402 can comprise said first outer absorber 1402*a* and said second outer absorber 1402*b*.

In one embodiment, said variable acoustic system 100 can comprise said outer portions 1400.

Figure 15:
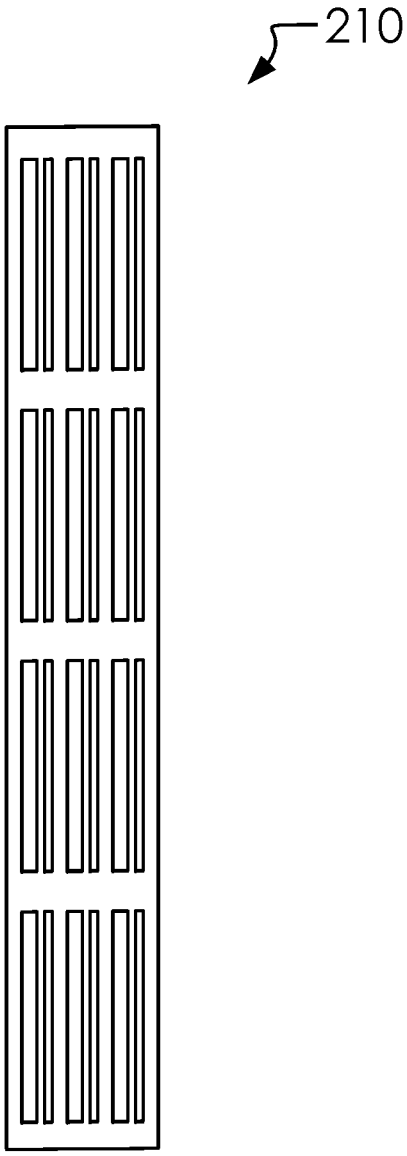
FIG. 15 illustrates an elevated front side view of a reflector plates 210.

FIG. 15 illustrates an elevated front side view of a reflector plates 210.

Figure 16:
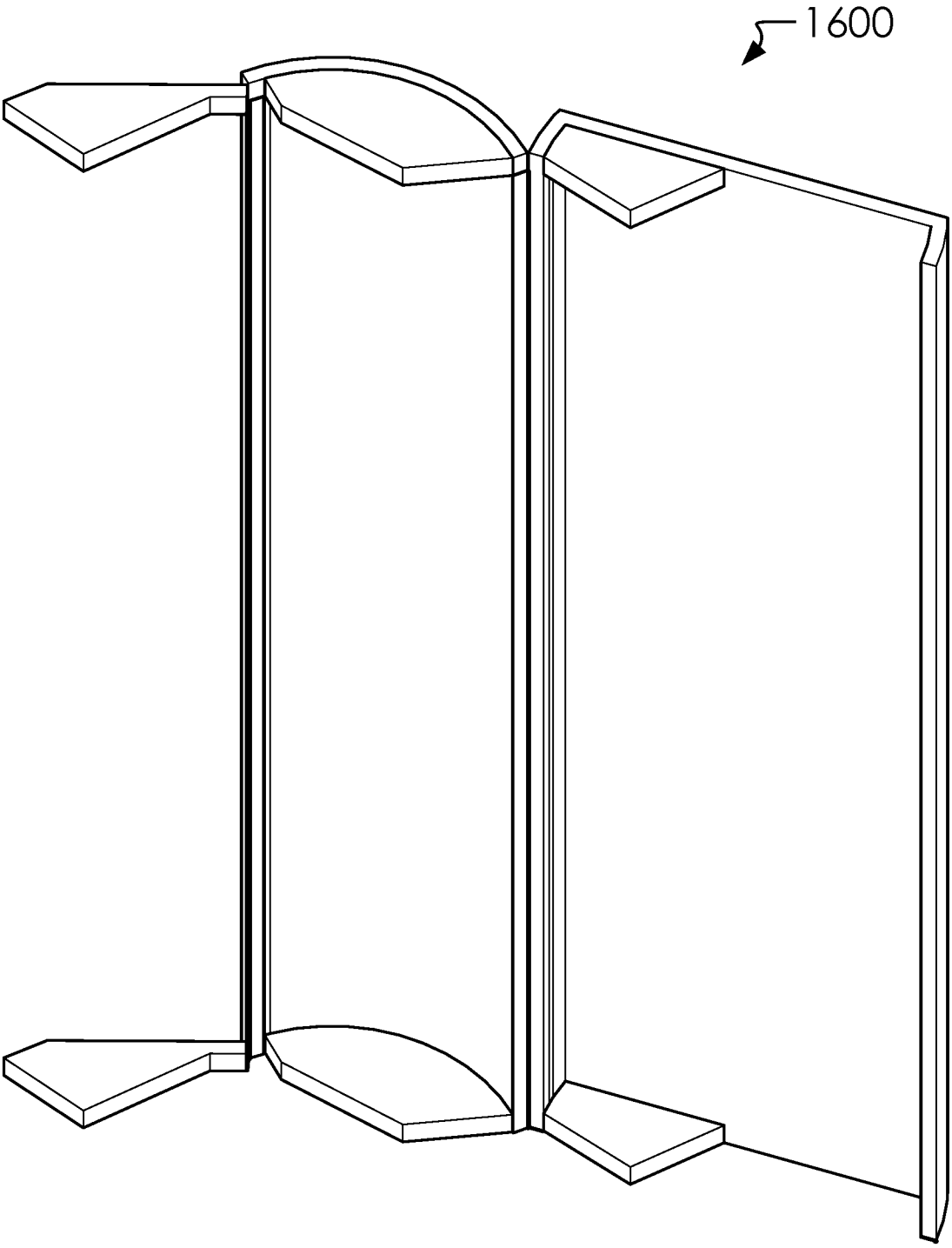
FIG. 16 illustrates a perspective overview view of a shell portions 1600.

FIG. 16 illustrates a perspective overview view of a shell portions 1600.

Figure 17:
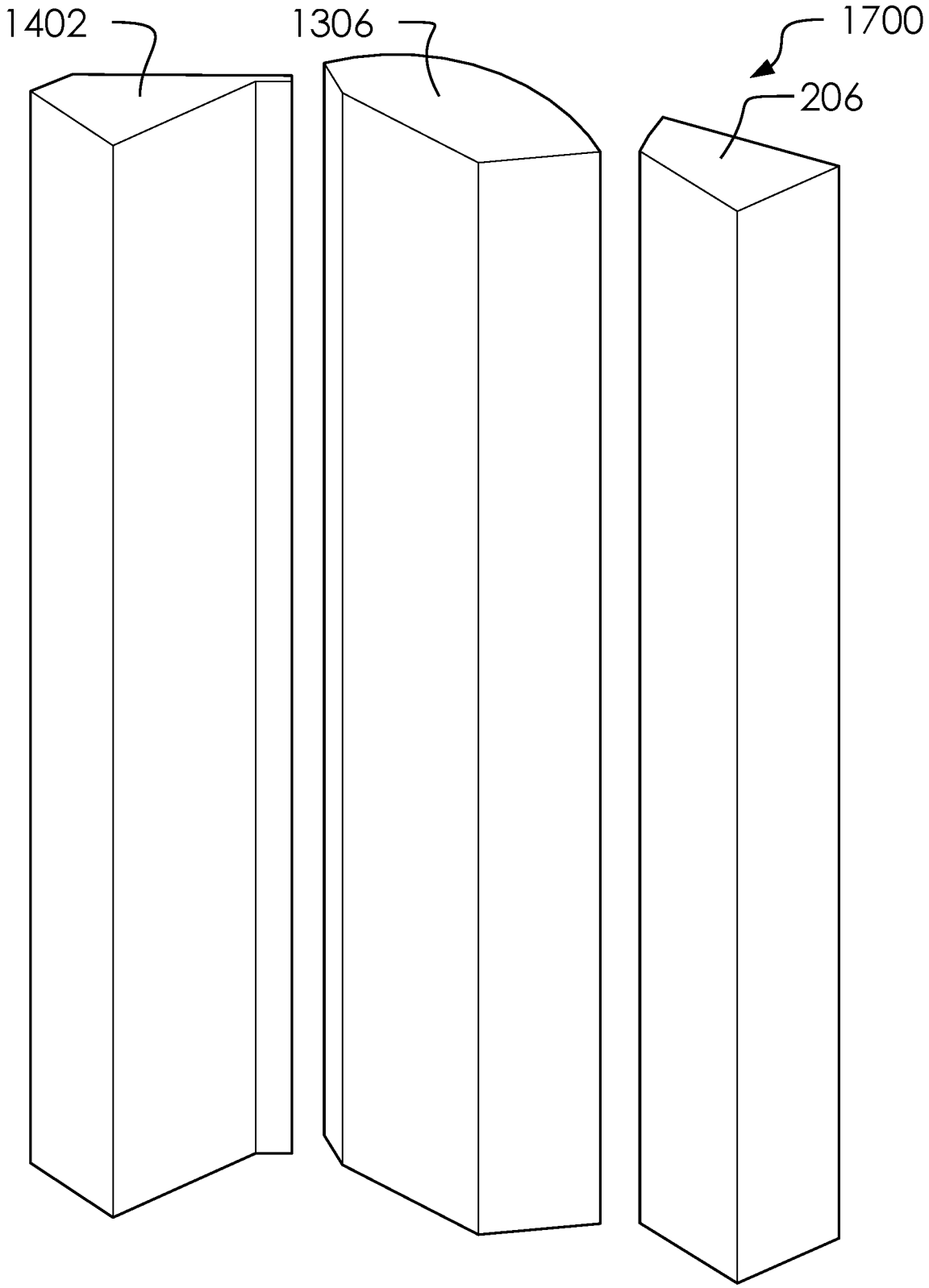
FIG. 17 illustrates a perspective overview view of a plurality of absorbers 1700.

FIG. 17 illustrates a perspective overview view of a plurality of absorbers 1700.

In one embodiment, said two side portions 102 can comprise said plurality of absorbers 1700.

Figure 18:
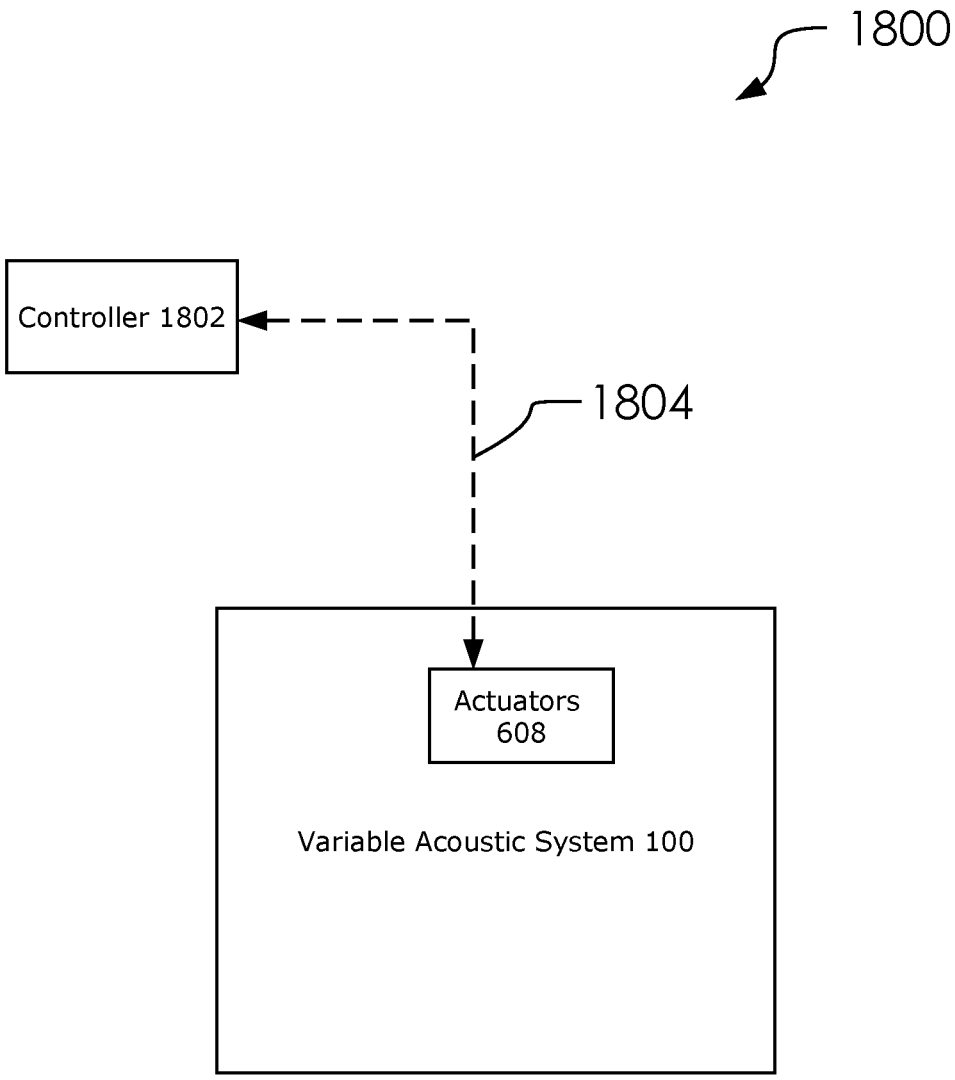
FIG. 18 illustrates view of a block diagram 1800.

FIG. 18 illustrates view of a block diagram 1800.

In one embodiment, said variable acoustic system 100 can comprise said controller 1802 and said control signals 1804.

Figure 19:
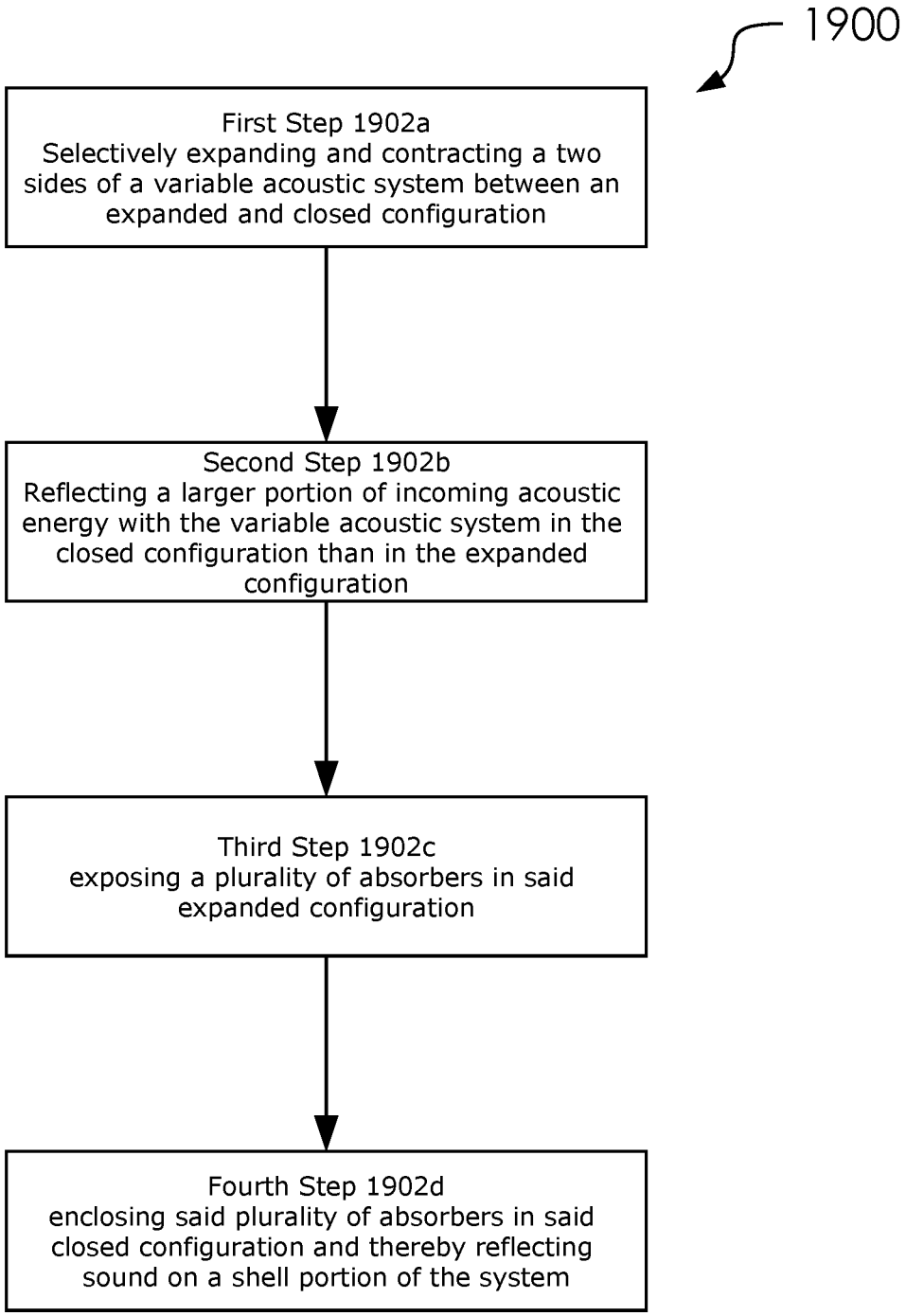
FIG. 19 illustrates a flow chart view of a method of using an acoustic system 1900.

FIG. 19 illustrates a flow chart view of a method of using an acoustic system 1900.

In one embodiment, said one or more steps 1902 can comprise said first step 1902*a*, said second step 1902*b*, said third step 1902*c* and said fourth step 1902*d*.

In one embodiment, said variable acoustic system 100 can comprise said method of using an acoustic system 1900.

In one embodiment, said actuator assemblies 608 can comprise said one or more steps 1902.

In one embodiment, method of using an acoustic system 1900 can comprise selectively expanding and contracting two side portions 102 between closed configuration 120*a* and open configuration 120*d*; reflecting a larger portion of incoming acoustic energy with variable acoustic system 100 in closed configuration 120*a* than in open configuration 120*d*; exposing said plurality of absorbers 1700 in said open configuration 120*d*; and enclosing said plurality of absorbers 1700 with variable acoustic system 100 in closed configuration 120*a* and thereby reflecting said incoming acoustic energy on shell 104 of variable acoustic system 100

The following sentences are included for completeness of this disclosure with reference to the claims.

A variable acoustic system 100 for selectively controlling acoustic properties of an environment. Said variable acoustic system 100 comprises a two side portions 102, a back portions 1200 and a variable expansion assembly 106. Said variable acoustic system 100 further comprises a shell 104 and a plurality of absorbers 1700. Said variable acoustic system 100 is configured to selectively transition through a one or more configurations 120. Said one or more configurations 120 comprises at least a closed configuration 120*a* and an open configuration 120*d*. Said closed configuration 120*a* comprises said two side portions 102 closed with said shell 104 exposed. Said open configuration 120*d* comprises said two side portions 102 open with a portion of said plurality of absorbers 1700 exposed. Said shell 104 configured to reflect more acoustic energy than said plurality of absorbers 1700. Said two side portions 102 comprise a first side portion 102*a* and a second side portion 102*b*. Said two side portions 102 each comprise at least an outer portions 202 and a back absorbers 206. Said back absorbers 206 are enclosed within a portion of said back portions 1200. Said outer portions 202 are enclosed in a portion of said two side portions 102. Portions of each of said two side portions 102 are configured to expand and contract on a plurality of axis hinges 500.

Said variable acoustic system 100 further comprising a reflector plates 210. Said reflector plates 210 configured to partially cover a portion of said plurality of absorbers 1700. Said reflector plates 210 comprising a pattern configured to provide a binary amplitude reflection with a portion of said plurality of absorbers 1700 exposed and a portion reflecting.

Said reflector plates 210 covering a portion of said outer portions 202. Said reflector plates 210 are partially exposed with said variable acoustic system 100 between said closed configuration 120*a* and said open configuration 120*d*, but not at all with said variable acoustic system 100 in said closed configuration 120*a*.

Said variable acoustic system 100 further comprising a controller 1802. Said controller 1802 configured to send and receive a control signals 1804 from an actuator assemblies 608 of said variable acoustic system 100. Said actuator assemblies 608 of said variable acoustic system 100 are configured to selectively move said variable acoustic system 100 between said one or more configurations 120.

Said two side portions 102 each comprise a middle portions 204, said outer portions 202 and said back portions 1200. Said outer portions 202 comprise an outer absorbers 1402. Said middle portions 204 comprise an absorber 1306. Said back portions 1200 comprise said back absorbers 206. Said plurality of absorbers 1700 comprise all of said outer absorbers 1402, said absorber 1306 and said back absorbers 206. Said outer portions 202 rotate relative to said middle portions 204 on a second axis hinges 504. Said middle portions 204 rotate relative to said back absorbers 206 on a first axis hinge 502. Said two side portions 102 expands and contracts on said plurality of axis hinges 500 between said closed configuration 120*a* and said open configuration 120*d*.

Each side of said two side portions 102 comprises a one or more brackets 602, a brackets 604, a brackets 606, an actuator assemblies 608 and a rods 610. Said variable expansion assembly 106 controls movement of said two side portions 102 through said one or more configurations 120. Said brackets 606 selectively expands and contracts to move portions of said variable expansion assembly 106 through said one or more configurations 120 between said closed configuration 120*a* and 102*d*/.

Said brackets 606 selectively pushes portions of said middle portions 204 away from said back portions 1200. Said rods 610 guides movement of said outer portions 202 relative to said back portions 1200. Said brackets 606 is rotateably mounted between said back absorbers 206 and said middle portions 204. Said actuator assemblies 608 is rotateably mounted to said back absorbers 206 with an interior axis 616 and to said middle portions 204 with an exterior axis 618. Said interior axis 616 is rotateably mounted across said variable expansion assembly 106 with a first middle portion 204*a* attached to a second back absorber 206*b* and a second middle portion 204*b* attached to a first back absorber 206*a*. Said actuator assemblies 608 is configured to push said middle portions 204 away from an opposite side of said variable expansion assembly 106.

Said rods 610 is rotateably attached between a portion of said back absorbers 206 and said outer portions 202 with an interior axis 612 attaching said back absorbers 206 to said rods 610, and an exterior axis 614 rotateably attached to said outer portions 202.

When said actuator assemblies 608 selectively expands and contracts, said middle portions 204 and said outer portions 202 rotate and expand between said closed configuration 120*a* and said open configuration 120*d*.

Said variable acoustic system 100 comprises a cart 1000. Said cart 1000 comprises a lift assembly 1002 and a one or more wheels 1004. A variable acoustic system 100 for selectively controlling acoustic properties of an environment.

Said variable acoustic system 100 comprises a two side portions 102, a back portions 1200 and a variable expansion assembly 106. Said variable acoustic system 100 further comprises a shell 104 and a plurality of absorbers 1700. Said variable acoustic system 100 is configured to selectively transition through a one or more configurations 120. Said one or more configurations 120 comprises at least a closed configuration 120*a* and an open configuration 120*d*. Said closed configuration 120*a* comprises said two side portions 102 closed with said shell 104 exposed. Said open configuration 120*d* comprises said two side portions 102 open with a portion of said plurality of absorbers 1700 exposed. Said shell 104 configured to reflect more acoustic energy than said plurality of absorbers 1700. Said two side portions 102 comprise a first side portion 102*a* and a second side portion 102*b*. Said two side portions 102 each comprise at least an outer portions 202 and a back absorbers 206. Said back absorbers 206 are enclosed within a portion of said back portions 1200. Said outer portions 202 are enclosed in a portion of said two side portions 102. Portions of each of said two side portions 102 are configured to expand and contract on a plurality of axis hinges 500. Said two side portions 102 each comprise a middle portions 204, said outer portions 202 and said back portions 1200. Said outer portions 202 comprise an outer absorbers 1402. Said middle portions 204 comprise an absorber 1306. Said back portions 1200 comprise said back absorbers 206. Said plurality of absorbers 1700 comprise all of said outer absorbers 1402, said absorber 1306 and said back absorbers 206. Said outer portions 202 rotate relative to said middle portions 204 on a second axis hinges 504. Said middle portions 204 rotate relative to said back absorbers 206 on a first axis hinge 502. Said two side portions 102 expands and contracts on said plurality of axis hinges 500 between said closed configuration 120*a* and said open configuration 120*d*. A method of using an acoustic system 1900 comprising:

Managing acoustic energy by selectively expanding and contracting a two side portions 102 between a closed configuration 120*a* and an open configuration 120*d*, reflecting a larger portion of incoming acoustic energy with a variable acoustic system 100 in said closed configuration 120*a* than in said open configuration 120*d*. Exposing a plurality of absorbers 1700 in said open configuration 120*d*, and enclosing said plurality of absorbers 1700 with said variable acoustic system 100 in said closed configuration 120*a* and thereby reflecting said incoming acoustic energy on a shell 104 of said variable acoustic system 100. Wherein. Said variable acoustic system 100 comprises said two side portions 102, a back portions 1200 and a variable expansion assembly 106. Said variable acoustic system 100 further comprises said shell 104 and said plurality of absorbers 1700. Said variable acoustic system 100 is configured to selectively transition through a one or more configurations 120. Said one or more configurations 120 comprises at least said closed configuration 120*a* and said open configuration 120*d*. Said closed configuration 120*a* comprises said two side portions 102 closed with said shell 104 exposed. Said open configuration 120*d* comprises said two side portions 102 open with a portion of said plurality of absorbers 1700 exposed. Said shell 104 configured to reflect more acoustic energy than said plurality of absorbers 1700. Said two side portions 102 comprise a first side portion 102*a* and a second side portion 102*b*. Said two side portions 102 each comprise at least an outer portions 202 and a back absorbers 206. Said back absorbers 206 are enclosed within a portion of said back portions 1200. Said outer portions 202 are enclosed in a portion of said two side portions 102. Portions of each of said two side portions 102 are configured to expand and contract on a plurality of axis hinges 500. Said two side portions 102 each comprise a middle portions 204, said outer portions 202 and said back portions 1200. Said outer portions 202 comprise an outer absorbers 1402. Said middle portions 204 comprise an absorber 1306. Said back portions 1200 comprise said back absorbers 206. Said plurality of absorbers 1700 comprise all of said outer absorbers 1402, said absorber 1306 and said back absorbers 206. Said outer portions 202 rotate relative to said middle portions 204 on a second axis hinges 504. Said middle portions 204 rotate relative to said back absorbers 206 on a first axis hinge 502. Said two side portions 102 expands and contracts on said plurality of axis hinges 500 between said closed configuration 120*a* and said open configuration 120*d*.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A variable acoustic system for selectively controlling acoustic properties of an environment, wherein:

said variable acoustic system comprises a two side portions, a back portions and a variable expansion assembly;

said variable acoustic system further comprises a shell and a plurality of absorbers;

said variable acoustic system is configured to selectively transition through a one or more configurations;

said one or more configurations comprises at least a closed configuration and an open configuration;

said closed configuration comprises said two side portions closed with said shell exposed;

said open configuration comprises said two side portions open with a portion of said plurality of absorbers exposed;

said shell configured to reflect more acoustic energy than said plurality of absorbers;

said two side portions comprise a first side portion and a second side portion;

said two side portions each comprise at least an outer portions and a back absorbers;

said back absorbers are enclosed within a portion of said back portions;

said outer portions are enclosed in a portion of said two side portions; and portions of each of said two side portions are configured to expand and contract on a plurality of axis hinges.

2. The variable acoustic system from claim 1, wherein:

said variable acoustic system further comprising a reflector plates;

said reflector plates configured to partially cover a portion of said plurality of absorbers; and said reflector plates comprising a pattern configured to provide a binary amplitude reflection with a portion of said plurality of absorbers exposed and a portion reflecting.

3. The variable acoustic system from claim 2, wherein:

said reflector plates covering a portion of said outer portions; and said reflector plates are partially exposed with said variable acoustic system between said closed configuration and said open configuration, but not at all with said variable acoustic system in said closed configuration.

4. The variable acoustic system from claim 1, wherein:

said variable acoustic system further comprising a controller;

said controller configured to send and receive a control signals from an actuator assemblies of said variable acoustic system; and said actuator assemblies of said variable acoustic system are configured to selectively move said variable acoustic system between said one or more configurations.

5. The variable acoustic system from claim 1, wherein:

said two side portions each comprise a middle portions, said outer portions and said back portions;

said outer portions comprise an outer absorbers;

said middle portions comprise an absorber;

said back portions comprise said back absorbers;

said plurality of absorbers comprise all of said outer absorbers, said absorber and said back absorbers;

said outer portions rotate relative to said middle portions on a second axis hinges;

said middle portions rotate relative to said back absorbers on a first axis hinge; and said two side portions expands and contracts on said plurality of axis hinges between said closed configuration and said open configuration.

6. The variable acoustic system from claim 5, wherein:

each side of said two side portions comprises a one or more brackets, a brackets, a brackets, an actuator assemblies and a rods;

said variable expansion assembly controls movement of said two side portions through said one or more configurations; and said brackets selectively expands and contracts to move portions of said variable expansion assembly through said one or more configurations between said closed configuration and 102*d*/.

7. The variable acoustic system from claim 6, wherein:

said brackets selectively pushes portions of said middle portions away from said back portions;

said rods guides movement of said outer portions relative to said back portions;

said brackets is rotateably mounted between said back absorbers and said middle portions;

said actuator assemblies is rotateably mounted to said back absorbers with an interior axis and to said middle portions with an exterior axis;

said interior axis is rotateably mounted across said variable expansion assembly with a first middle portion attached to a second back absorber and a second middle portion attached to a first back absorber; and said actuator assemblies is configured to push said middle portions away from an opposite side of said variable expansion assembly.

8. The variable acoustic system from claim 7, wherein:

said rods is rotateably attached between a portion of said back absorbers and said outer portions with an interior axis attaching said back absorbers to said rods, and an exterior axis rotateably attached to said outer portions.

9. The variable acoustic system from claim 8, wherein:

when said actuator assemblies selectively expands and contracts, said middle portions and said outer portions rotate and expand between said closed configuration and said open configuration.

10. The variable acoustic system from claim 1, wherein:

said variable acoustic system comprises a cart; and said cart comprises a lift assembly and a one or more wheels.

11. A method of using an acoustic system comprising:

managing acoustic energy by selectively expanding and contracting a two side portions between a closed configuration and an open configuration, reflecting a larger portion of incoming acoustic energy with a variable acoustic system in said closed configuration than in said open configuration; exposing a plurality of absorbers in said open configuration, and enclosing said plurality of absorbers with said variable acoustic system in said closed configuration and thereby reflecting said incoming acoustic energy on a shell of said variable acoustic system; wherein;

said variable acoustic system comprises said two side portions, a back portions and a variable expansion assembly;

said variable acoustic system further comprises said shell and said plurality of absorbers;

said variable acoustic system is configured to selectively transition through a one or more configurations;

said one or more configurations comprises at least said closed configuration and said open configuration;

said closed configuration comprises said two side portions closed with said shell exposed;

said open configuration comprises said two side portions open with a portion of said plurality of absorbers exposed;

said shell configured to reflect more acoustic energy than said plurality of absorbers;

said two side portions comprise a first side portion and a second side portion;

said two side portions each comprise at least an outer portions and a back absorbers;

said back absorbers are enclosed within a portion of said back portions;

said outer portions are enclosed in a portion of said two side portions;

portions of each of said two side portions are configured to expand and contract on a plurality of axis hinges;

said two side portions each comprise a middle portions, said outer portions and said back portions;

said outer portions comprise an outer absorbers;

said middle portions comprise an absorber;

said back portions comprise said back absorbers;

said plurality of absorbers comprise all of said outer absorbers, said absorber and said back absorbers;

said outer portions rotate relative to said middle portions on a second axis hinges;

said middle portions rotate relative to said back absorbers on a first axis hinge; and said two side portions expands and contracts on said plurality of axis hinges between said closed configuration and said open configuration.

* * * * *